US005413125A

United States Patent [19]

Waranch et al.

[11] Patent Number: 5,413,125

[45] Date of Patent: May 9, 1995

[54] METHOD OF APPLYING AN INTRACELLULAR HAIR RECONSTRUCTION SYSTEM TO A PERSON'S HEAD

[75] Inventors: Jonathan S. Waranch, Owings Mills; Michael E. Baylin, Baltimore, both of Md.

[73] Assignee: Waye Laboratories, Inc., Timonium, Md.

[21] Appl. No.: 132,714

[22] Filed: Oct. 6, 1993

[51] Int. Cl.[6] ..... A41G 5/00

[52] U.S. Cl. ..... 132/201; 132/54

[58] Field of Search ..... 132/53, 54, 56, 201

[56] References Cited

U.S. PATENT DOCUMENTS

| | | | |
|---|---|---|---|
| 2,907,334 | 10/1959 | Le Mole | 271/5 |
| 3,037,261 | 6/1962 | Hess | 28/74 |
| 3,077,891 | 2/1963 | Lane | 132/201 |
| 3,189,035 | 6/1965 | Heck | 132/201 |
| 3,421,521 | 1/1969 | Rich et al. | 132/201 |
| 3,520,309 | 7/1970 | Lane et al. | 132/53 |
| 3,970,092 | 7/1976 | Nelson | 132/5 |
| 4,155,370 | 5/1979 | Memoto | 132/53 |
| 4,168,713 | 9/1979 | Agiotis | 132/53 |
| 4,176,669 | 12/1979 | Levin | 132/201 |
| 4,205,693 | 6/1980 | Mallouf | 132/53 |
| 4,254,783 | 3/1981 | Kim | 132/11 R |
| 4,254,784 | 3/1981 | Nelson | 132/53 |
| 4,284,092 | 8/1981 | Auretta | 132/53 |
| 4,296,765 | 10/1981 | Bachtell | 132/53 |
| 4,372,330 | 2/1983 | Nelson | 132/53 |
| 4,509,539 | 4/1985 | Alfieri | 132/53 |
| 4,517,999 | 5/1985 | Finamore | 132/201 |
| 4,606,359 | 8/1986 | Palumbo et al. | 132/53 |
| 4,688,584 | 8/1987 | Nilsen | 132/56 |
| 4,745,933 | 5/1988 | Saenger | 132/53 |
| 4,865,057 | 9/1989 | Braun | 132/201 |
| 4,947,877 | 8/1990 | Meyer et al. | 132/201 |
| 4,964,428 | 10/1990 | Lamatrice | 132/216 |
| 5,005,594 | 4/1991 | Dunagan | 132/53 |
| 5,033,486 | 7/1991 | Finamore et al. | 132/201 |
| 5,060,677 | 10/1991 | Duffel | 132/53 |

*Primary Examiner*—John G. Weiss

*Attorney, Agent, or Firm*—Leonard Bloom

[57] ABSTRACT

A template is made of the bald portion of the person's head and a membrane base of an intracellular hair reconstruction system is adapted to replicate the template. The bald portion is marked and the intracellular hair reconstruction system temporarily taped to the marked portion to assure the desired fit and styling. The intracellular hair reconstruction system is placed on a mannequin head with the hair in contact with the mannequin head. A uniform coating of adhesive is placed on the membrane base and is heat cured. The adhesive coated membrane base is carefully aligned with markings on the bald portion of the person's head and is adhered to the person's head.

13 Claims, 13 Drawing Sheets

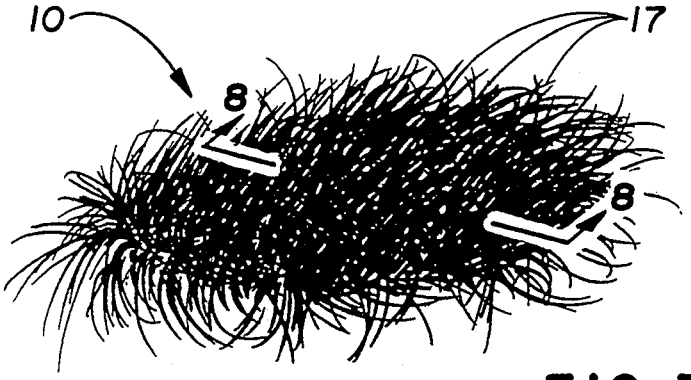
FIG. 7
FIG. 8
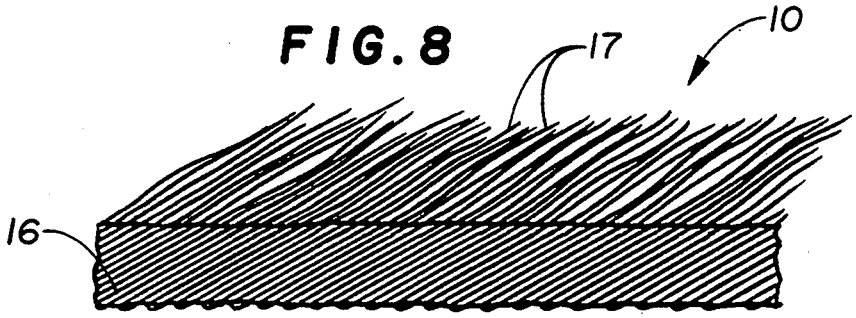
FIG. 9
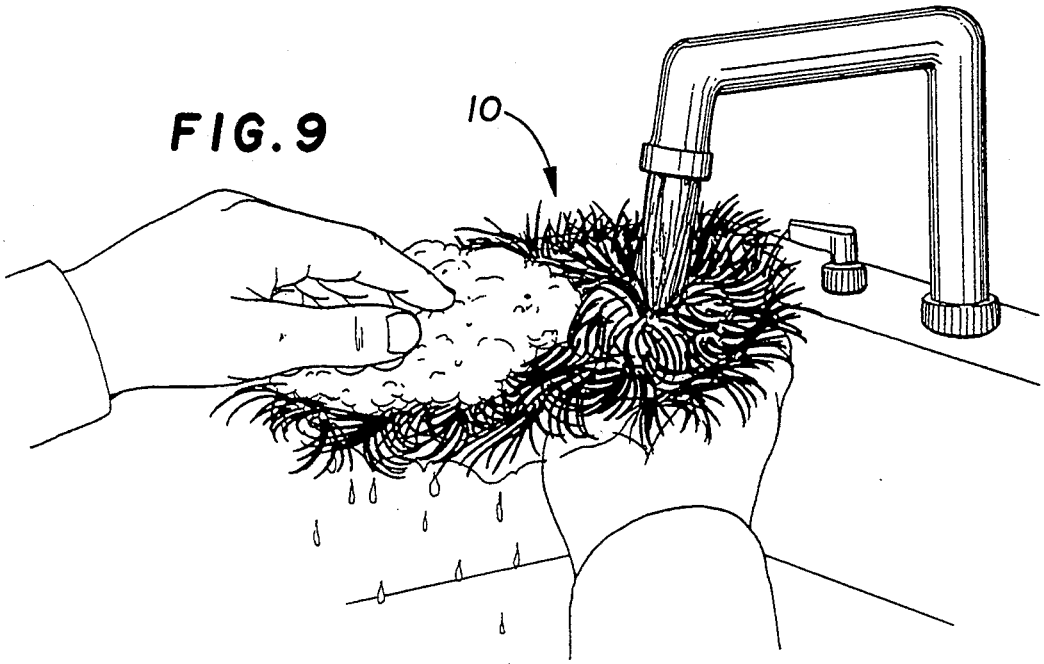

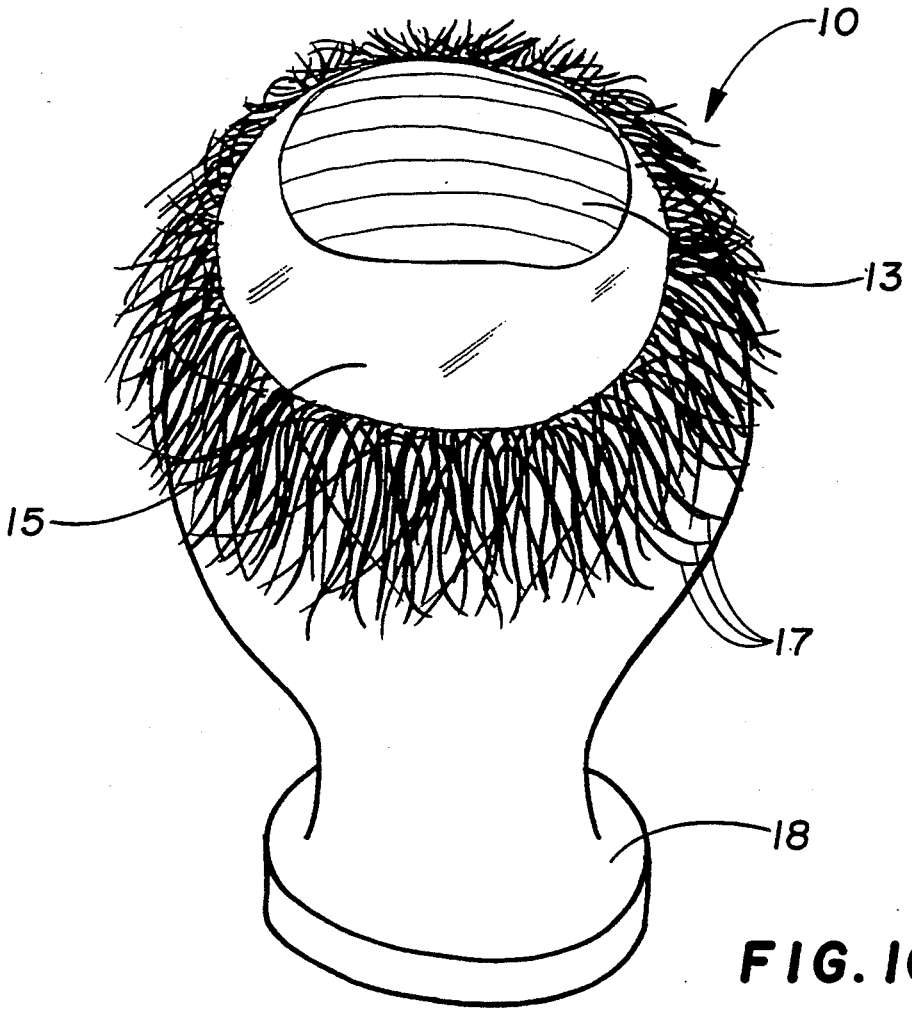
FIG. 10
FIG. 11
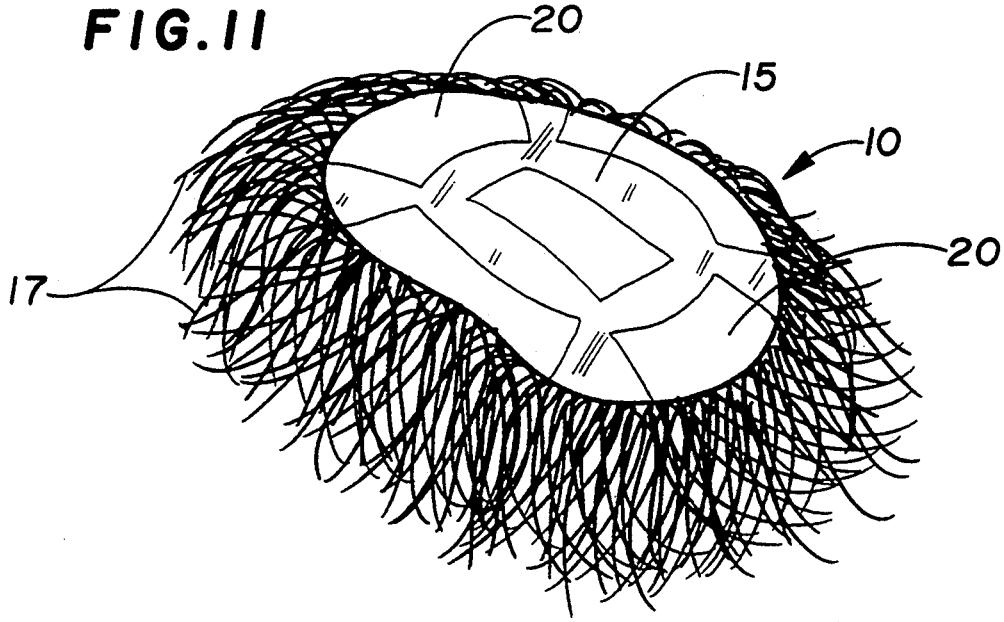

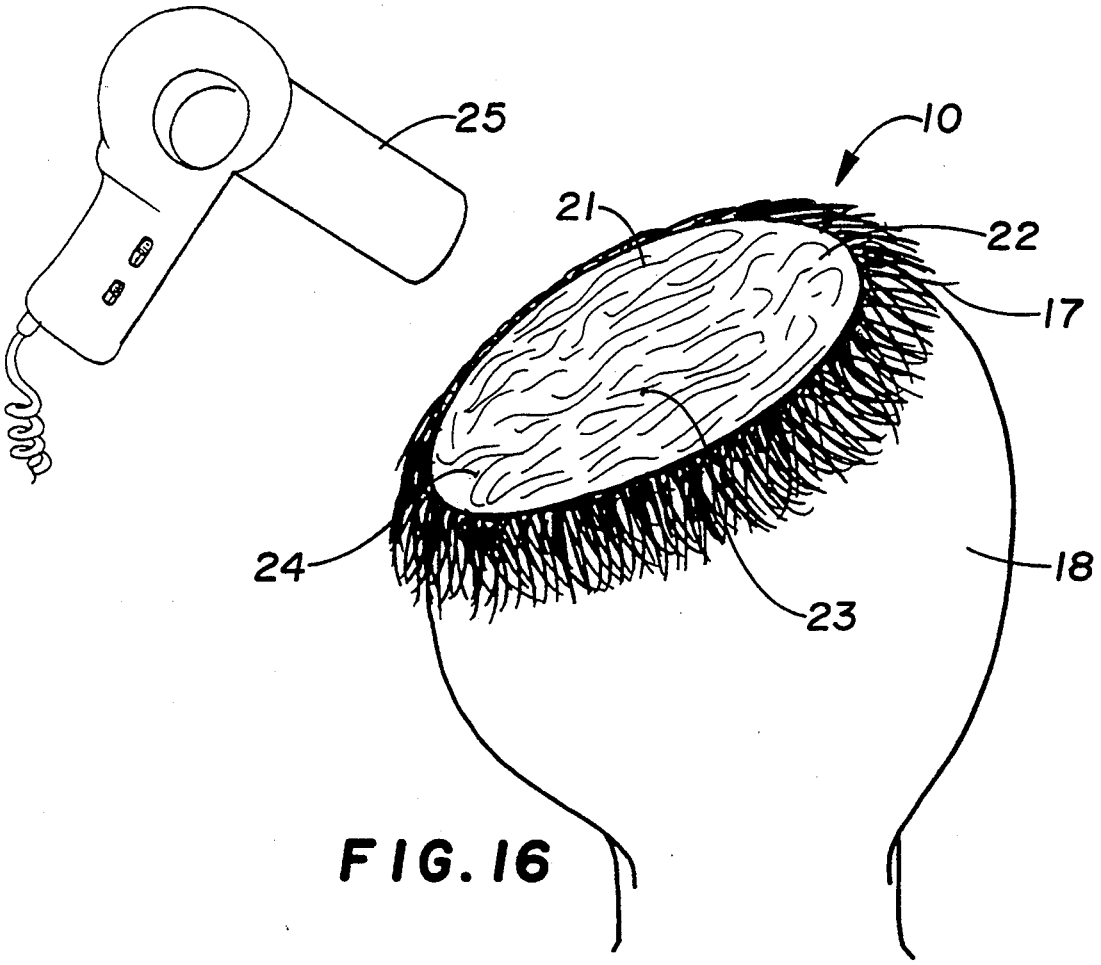
FIG. 16
FIG. 17
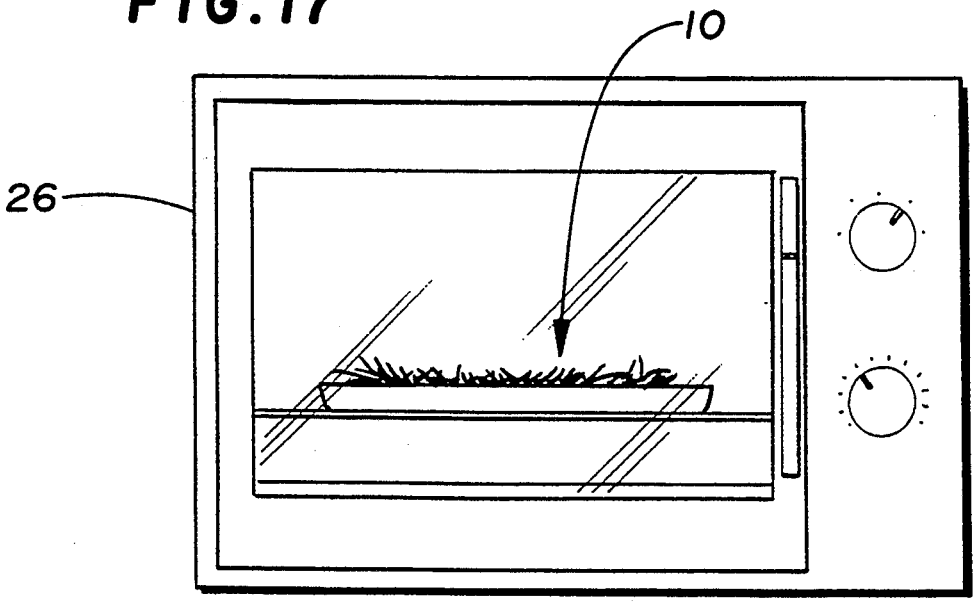

TO FIG. 22B

FROM FIG. 22B

PLACING THE I H R SYSTEM WITH ADHESIVE ON THE FIRST SIDE THEREOF IN A PREHEATED CONVECTION OVEN FOR APPROXIMATELY THREE AND ONE-HALF MINUTES AT APPROXIMATELY 250°F

REMOVING THE I H R SYSTEM FROM THE OVEN AND EXAMINING THE ADHESIVE COATING FOR UNIFORM COVERAGE

MISTING THE HAIR WITH WATER

APPLYING A THIN BEAD OF ADHESIVE IN A ZIG-ZAG PATTERN TO THE COATED FIRST SIDE OF THE MEMBRANE AND PLACING THE I H R SYSTEM IN THE PREHEATED CONVECTION OVEN FOR APPROXIMATELY FIVE MINUTES AT APPROXIMATELY 250°F, WHEREBY THE ADHESIVE IS CURED

REMOVING THE I H R SYSTEM FROM THE OVEN AND TESTING THE ADHESIVE FOR TACKINESS

WITHIN APPROXIMATELY SEVEN TO TEN MINUTES AFTER REMOVAL FROM THE OVEN, ALIGNING THE FRONT EDGE OF THE FIRST SIDE OF THE MEMBRANE, HAVING THE CURED ADHESIVE THEREON, WITH THE MARKINGS ON THE FRONT EDGE OF THE BALD PORTION OF THE PERSON'S HEAD AND PLACING THE I H R SYSTEM ON THE BALD PORTION FROM THE FRONT EDGE TOWARD THE BACK OF THE PERSON'S HEAD WHILE KEEPING THE MEMBRANE TAUT, PRESSING THE MEMBRANE FIRMLY AGAINST THE BALD PORTION WHEREBY THE I H R SYSTEM IS ADHERED TO THE PERSON'S HEAD

FIG. 22C

METHOD OF APPLYING AN INTRACELLULAR HAIR RECONSTRUCTION SYSTEM TO A PERSON'S HEAD

FIELD OF THE INVENTION

The present invention relates to a covering for a bald portion of a person's head and more particularly, to a method of adhering an intracellular hair reconstruction system to the bald portion and of assuring the desired placement thereon.

BACKGROUND OF THE INVENTION

Throughout history men and women of all ages have suffered different degrees of topical hair loss. The quest for an effective solution to hair loss has lead to the outgrowth of various surgical and non-surgical alternatives. This has fostered the growth of the market for hair replacement options into a multi-billion dollar a year industry.

Hair loss, through fallout or thinning, can be temporary or permanent. Factors that may lead to hair loss include stress, depression, and nutritional deficiency. Permanent hair loss can be triggered by cell structures that are genetically imbalanced. Continuing research has been done investigating genes that are affected by androgens (hormones that trigger certain kinds of hair loss). Several conditions that cause genetic imbalances, and that are found to affect as many men as women, include androgenetic alopecia, better known as common hereditary thinning, alopecia areata, a condition in which hair falls out in patches, and alopecia universalis, in which hair falls out universally. Temporary hair loss has been observed in women who have recently gone through childbirth, or can be the result of an iron deficiency caused by a women's menstrual cycle. Throughout it all, the absolute fact remains that whether one's hair loss is temporary or permanent, the impact of a hair loss problem is deeply psychological.

There are several surgical options available in treating a hair loss problem. The major problem with surgical procedures are that they are costly and somewhat risky, with unpredictable results which are at best, still much too detectable. These include hair transplants such as micrografts and mini-grafts (where one to four hairs are transplanted at a time), and split-grafts (the process of sliding tiny groups of hairs along a slit instead of a circular clump as in older procedures). Another type of surgical procedure, scalp reduction, is performed by literally slicing out a large section of a balding scalp and stretching and sewing the remaining flaps back together.

In 1988, with the FDA's approval of the use of minoxodil as a topical drug to treat hair loss, research into a whole new generation of drugs and restorative treatments has proliferated.

With the significant cost and the history of unspectacular and in many cases unsatisfactory results associated with both surgical procedures and drug treatments, non-surgical alternatives have created enormous growth in the hair replacement industry. These alternatives have included wigs, toupees, hair weaves and hair extensions all of which attach to existing hair growth, creating bulk, ridges and seams which can be readily felt, often seen, and have a very low measure of security (the ability of the hair to come off or lift up). These options have provided solutions that have been minimal in their cosmetic delivery and have typically been uncomfortable to wear.

The applicant is aware of the following patents which disclose hair replacement approaches:

| Inventor(s) | U.S. Pat. No. |
|---|---|
| Le Mole | 2,907,334 |
| Hess | 3,037,261 |
| Nelson | 3,970,092 |
| Nemoto | 4,155,370 |
| Agiotis | 4,168,713 |
| Mallouf | 4,205,693 |
| Kim | 4,254,783 |
| Nelson | 4,254,784 |
| Auretta | 4,284,092 |
| Bachtell | 4,296,765 |
| Nelson | 4,372,330 |
| Alfieri | 4,509,539 |
| Palumbo et al | 4,606,359 |
| Nilsen | 4,688,584 |
| Saenger | 4,745,933 |
| Meyer et al | 4,947,877 |
| Lamatrice | 4,964,428 |
| Dunagan | 5,005,594 |
| Finamore et al | 5,033,486 |
| Duffel | 5,060,677 |

Most of the mechanical means for retaining the hairpiece on the person's head have not received general acceptance and have little use.

While several of these references disclose the use of adhesive, the method of preparing the hairpiece to receive the adhesive and the means of applying the adhesive to the person's head are not disclosed. To provide a natural appearance and to assure retention of the hairpiece on the person's head, information on the adhesive is necessary.

Also, as noted in U.S. Pat. No. 4,865,057, correct positioning of the hairpiece on the person's head is extremely important. However, the reference discloses a mask to be used by the wearer to reproducibly position the hairpiece and does not suggest the use of adhesive. U.S. Pat. Nos. 1,906,954, 4,509,539 and 5,060,677 recognize the need to prepare a pattern for forming the hairpiece. These patents do not disclose the method of marking the bald portion and preparing a template from the markings such that the template is used in forming the hairpiece and positioning and adhering the hairpiece on the person's head.

Thus, with the widespread use of hairpieces, there remains a need for a method to accurately measure the bald portion of the head, prepare a hairpiece to properly cover the bald portion and securely adhere the hairpiece to the person's head. The method must be customized for each individual for the shape of the person's head, the dimensions of the bald portion and the color and texture of the hair and should appear natural so that even professionals find the presence of the intracellular hair reconstruction system difficult to detect.

SUMMARY OF THE INVENTION

It is a primary object of the present invention to provide a semi-permanent hair piece that offers security, comfort and undetectability to the wearer.

It is an additional object of the present invention to provide a method of accurately marking the bald portion of a person's head and preparing a template to be used for sizing and positioning an intracellular hair reconstruction system on the person's head.

It is a further object of the present invention to provide a method of coating a membrane of the intracellular hair reconstruction system with adhesive, curing the adhesive and adhering the intracellular hair reconstruction system to the desired position on the person's head.

In accordance with the teachings of the present invention, a method is disclosed for applying an intracellular hair reconstruction system to a person's head to cover a bald portion of the person's head. The intracellular hair reconstruction system has a plastic membrane base. The membrane has a front edge, a first side and a second side. Hair is attached to the membrane and extends from the second side of the membrane. The hair is customized to match the person's natural hair in color and texture. A location is marked on a front edge of the bald portion to which the front edge of the membrane is to be attached. The intracellular hair reconstruction system is placed on a mannequin head with the hair in contact with the mannequin head. A thin coating of adhesive is applied uniformly over the first side of the membrane. The coating of adhesive is dried with a hand-held drier. The intracellular hair reconstruction system is removed from the mannequin head and the intracellular hair reconstruction system with the adhesive on the first side thereof, is placed in a preheated convection oven for approximately three and one-half minutes at approximately 250° F. The intracellular hair reconstruction system is removed from the oven, the adhesive coating is examined for uniform coverage and is tested for tackiness. Within approximately seven to ten minutes after removal from the oven, the front edge of the membrane, having the cured adhesive thereon, is aligned with the marking on the front edge of the bald portion. The intracellular hair reconstruction system is pressed against the bald portion from the front edge of the bald portion to the back of the person's head while keeping the membrane taut whereby the intracellular hair reconstruction system is adhered to the person's head.

In further accordance with the teaching of the present invention a method is disclosed for applying an intracellular hair reconstruction system to a person's head to cover a bald portion of the person's head. The intracellular hair reconstruction system has a plastic membrane base. The membrane base has a front edge, a first side and a second side. Hair is attached to the membrane base and extends from the second side of the membrane base. The hair is customized to match the person's natural hair in color and texture. A template of the bald portion is prepared which is specific to the person. The membrane base is adapted to the template to replicate the template, and to be no larger than the template. Preliminarily, the intracellular hair reconstruction system is placed on the person's head and the intracellular hair reconstruction system is adjusted for desired fit and styling. The person's head is marked for placement of the intracellular hair reconstruction system. The intracellular hair reconstruction system is removed from the person's head. A uniform coating of adhesive is applied on the first side of the membrane base. The intracellular hair reconstruction system is heated thereby curing the adhesive on the membrane base. Within seven to ten minutes, after heating, the membrane base is placed on the bald portion to conform with the marking on the person's head. The membrane is firmly pressed against the bald portion such that the intracellular hair reconstruction system is adhered to the person's head.

These and other objects of the present invention will become apparent from a reading of the following specification, taken in conjunction with the enclosed drawings.

BRIEF DESCRIPTION OF THE DRAWINGS

FIG. 7 is a perspective view showing the intracellular hair reconstruction system of the present invention.

FIG. 8 is a cross-sectional view taken across the lines 8—8 of FIG. 7.

FIG. 9 is a perspective view showing shampooing the intracellular hair reconstruction system prior to the fitting to the person's head.

FIG. 10 is a perspective view showing the template disposed over the membrane of the intracellular hair reconstruction system to assure replication of the template pattern on the membrane.

FIG. 11 is a perspective view showing placement of double-sided adhesive tape on the membrane to permit test adhesion to the person's head.

FIG. 16 is a perspective view showing drying of the adhesive on the membrane using a hand-held drier.

FIG. 17 is a perspective view showing the intracellular hair reconstruction system in an oven to cure the adhesive.

FIGS. 22A–22C is a flowchart of the method of the present invention.

DETAILED DESCRIPTION OF THE PREFERRED EMBODIMENTS

Figure 2:
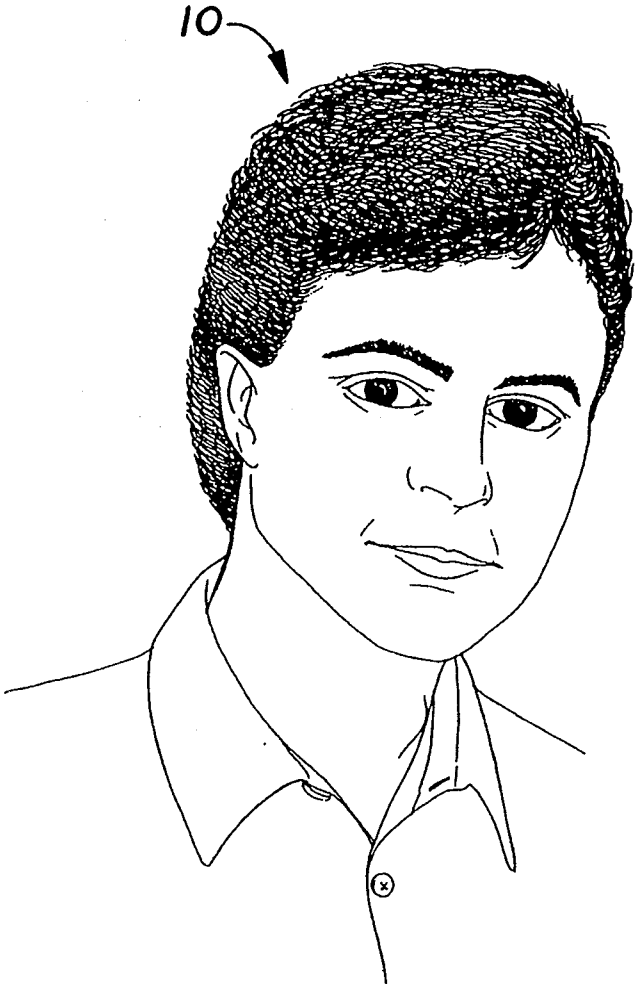
FIG. 2 is a perspective view of the person showing an intracellular hair reconstruction system covering the bald portion in accordance with the method of the present invention.
Figure 1:
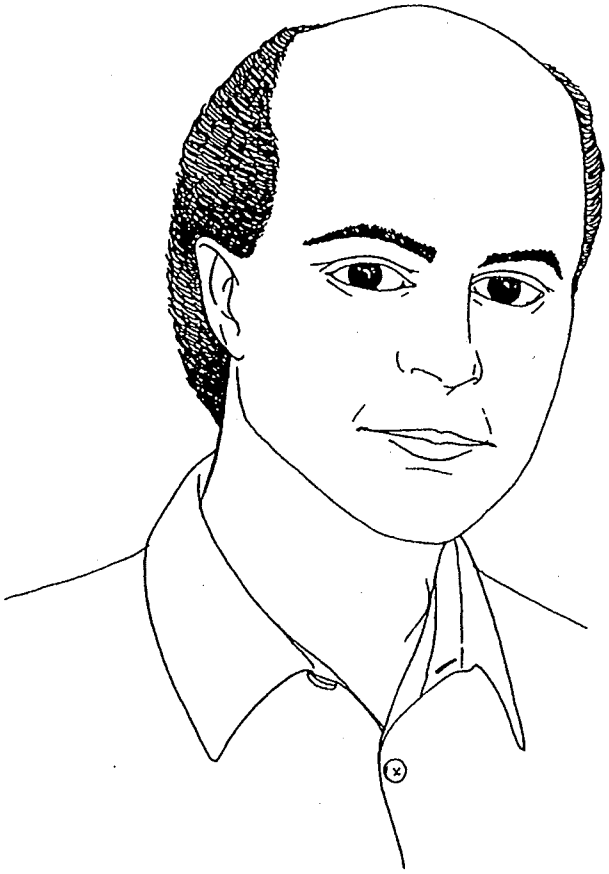
FIG. 1 is a perspective view of a person showing a bald portion in the hair on the person's head.

The bald portion in the hair on a person's head and the visual benefits to be obtained with method of the present invention to fit an intracellular hair reconstruction system 10 to the person's head are shown in FIGS. 1–2.

Figure 3:
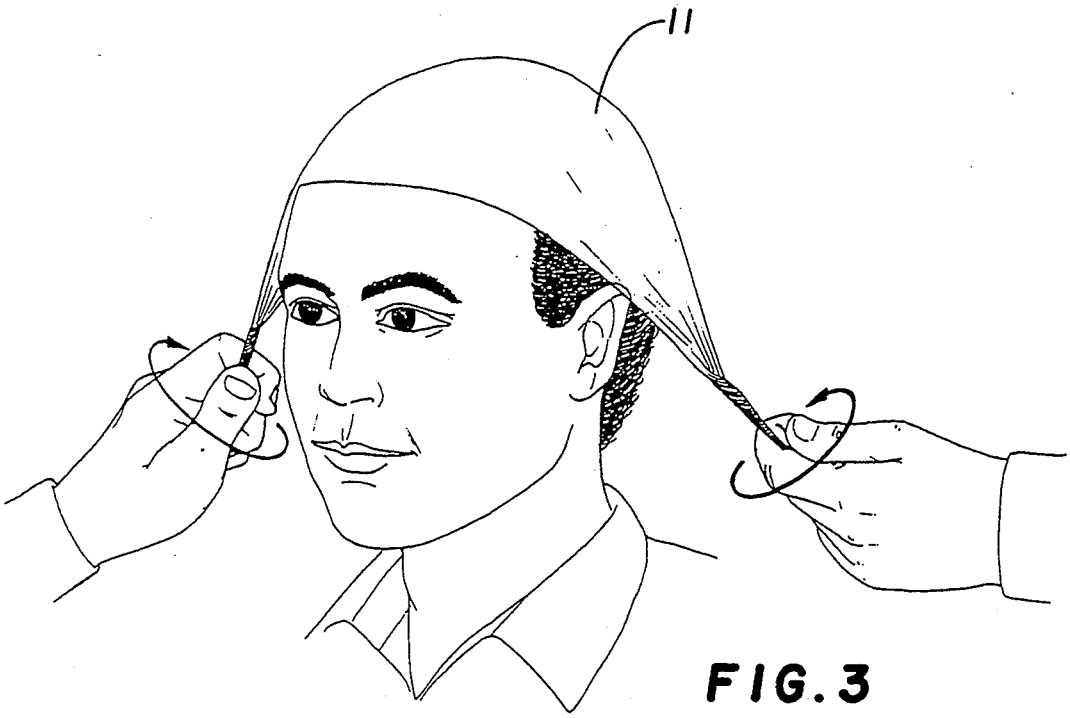
FIG. 3 is a perspective view showing a thin sheet of transparent plastic being fitted to the person's head to form a template.
Figure 4:
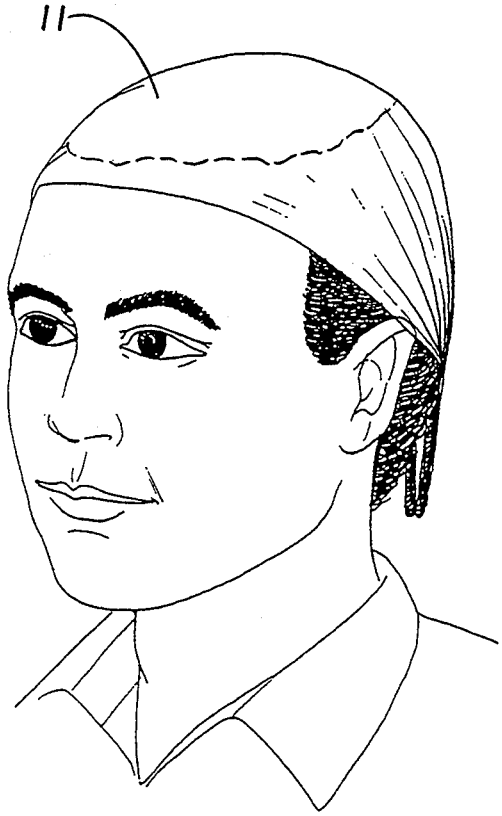
FIG. 4 is a perspective view showing markings on the plastic to delineate the bald portion for the template.

The initial step in the method is to stretch a sheet of clear, preferably transparent, plastic 11 over the entire top of the person's head. The plastic 11 is stretched over the entire top of the head and pulled down to lay smoothly on the scalp. The plastic must extend approximately six to eight inches past the person's ears so that the ends can be twisted and the sheet pulled taut (FIG. 3). The top of the person's head is viewed through the plastic 11 and the perimeter of the area of reconstruction around the bald portion is outlined with a marker such as a felt tip marker. Care is taken to assure that the outline remains within the perimeter of the natural growing hair of the person (FIG. 4).

Figure 5:
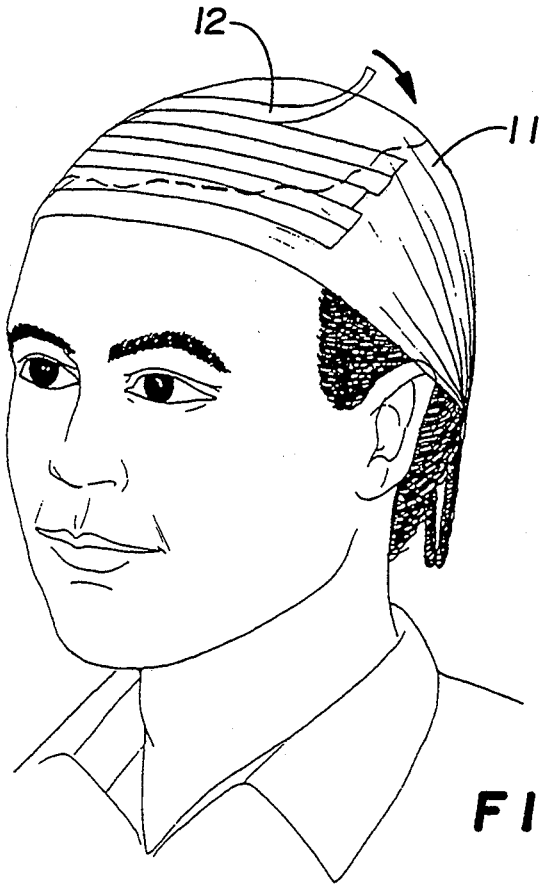
FIG. 5 is a perspective view showing reinforcement of the plastic to form the template.
Figure 6:
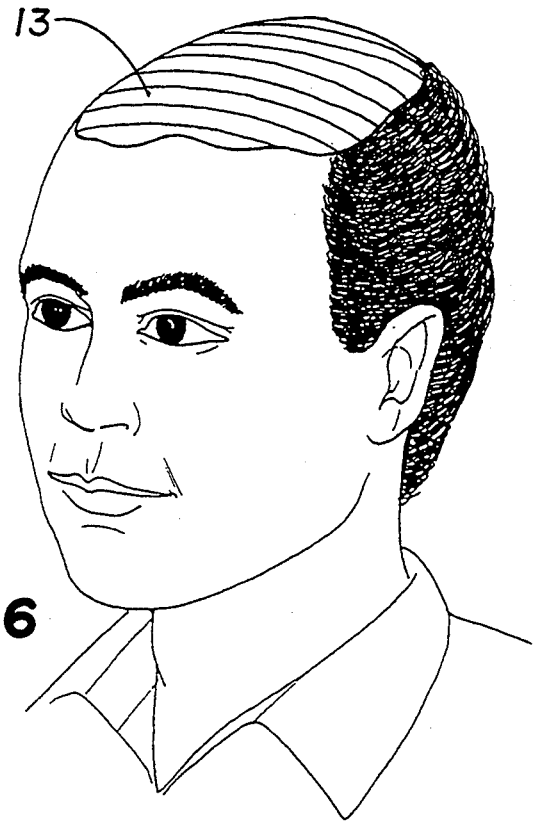
FIG. 6 is a perspective view showing the template formed from the plastic and fitted to the bald portion on the person's head.

The plastic 11 is reinforced such as by applying transparent adhesive-backed tape 12 to the plastic 11. The reinforced plastic 11 is marked to correspond with the front and back of the person's head (FIG. 5). The reinforced plastic 11 is removed from the person's head and the plastic 11 is cut to correspond to the outline of the area of reconstruction so that a template 13 is formed. The template 13 is placed on the marked bald portion of the person's head to confirm the accuracy of the template 13 (FIG. 6). The template 13 is removed from the person's head and appropriately marked with the identification of the person. The person's natural hair is checked for hair color, texture and thickness and a small hair sample is taken and placed in a marked container for subsequent use.

The intracellular hair reconstruction system 10 has previously been prepared for the person to correspond with the hair color and texture of the person. The intracellular hair reconstruction system (hairpiece) 10 has a polyurethane resin plastic membrane base 14 which has a first side 15 and a second side 16. Hair strands 17 are attached to the membrane base 14 at approximately a 30° angle and extend outwardly from the second side 16 of the membrane base 14. The hair 17 may be human hair, artificial hair or a combination of human and artificial hair (FIGS. 7, 8).

The intracellular hair reconstruction system 10 is shampooed (FIG. 9), combed, brushed and placed on a mannequin head 18 with the hair 17 in contact with the mannequin head 18 and the first side 15 of the membrane 14 oriented away from the mannequin head 18.

The template 13 is inverted and placed over the first side 15 of the membrane 17. The front of the template 13 is placed to coincide with the front of the membrane base 14 and the template 13 and membrane base 14 compared to determine the extent of replication between the two. The template 13 must be equal to or smaller than the membrane base 14 (FIG. 10). If the membrane base 14 is larger, markings are made on the membrane base 14 to show where size reduction is needed. The membrane base 14 is carefully cut with fine pointed scissors (like manicure scissors) starting at the edge of the membrane base 14 and cutting inwardly. When cutting on the front hairline, care must be exercised to avoid cutting hairs 17 which are adjacent to the edge of the membrane 14.

As seen in FIG. 11, a plurality of strips of double-sided adhesive tape 20 are applied around the circumference and along the length of the first side 15 of the membrane base 14.

Figure 12:
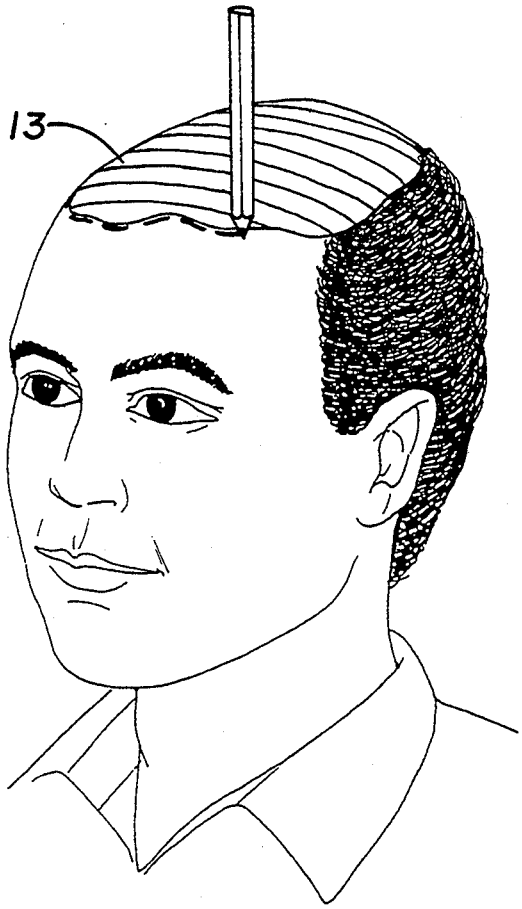
FIG. 12 is a perspective view showing the template disposed on the person's head and markings on the person's head to show the location of the template.
Figure 13:
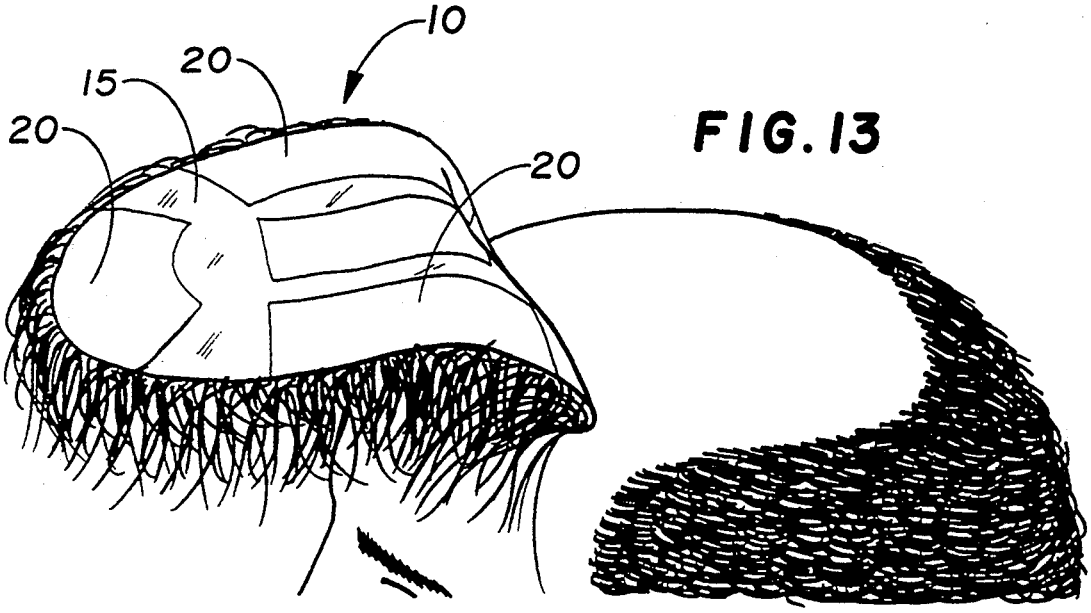
FIG. 13 is a perspective view showing alignment of the membrane of the intracellular hair reconstruction system with the markings on the person's head to provide proper alignment of the membrane on the bald portion.
Figure 14:
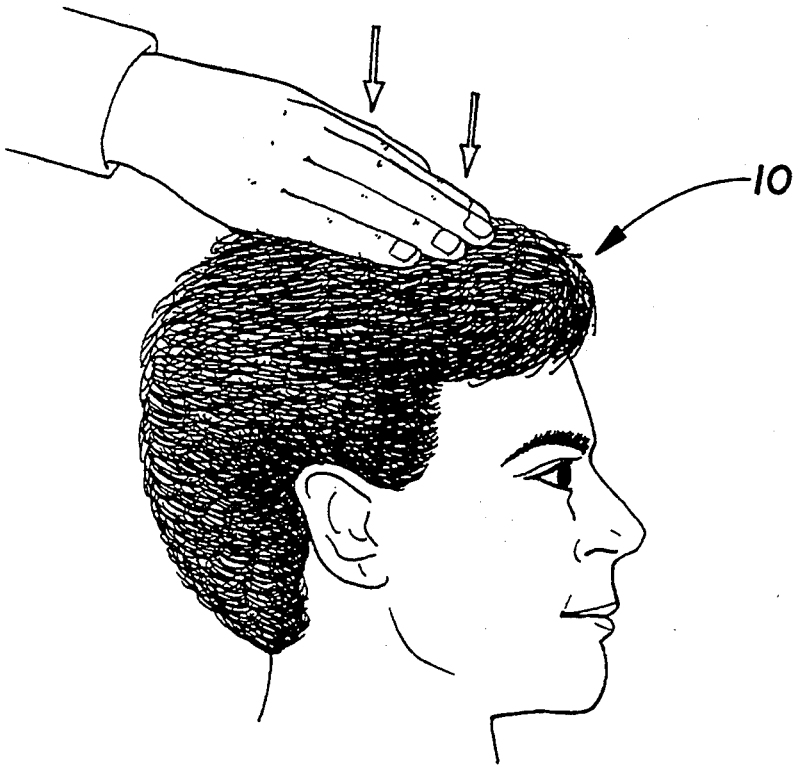
FIG. 14 is a perspective view showing temporary placement of the adhesive taped intracellular hair reconstruction system on the person's head.

The template 13 is placed on the bald portion of the person's head and with a skin marker, the front edge of the bald portion is marked to correspond with the first edge of the template 13 (FIG. 12). The template 13 is removed from the person's head and the intercellular hair reconstruction system 10 is placed on the person's head and aligned with the markings on the bald portion. The front center edge of the membrane base 14 is initially aligned with the markings (FIG. 13). Pressure (by hand) is applied to the intracellular hair reconstruction system 10 so that the adhesive tape on the first side 15 of the membrane base 14 adheres to the bald portion. The placement, fit and grooming of the intracellular hair reconstruction system 10 is checked (FIG. 14). Initial styling of the intracellular hair reconstruction system 10 is performed.

The intracellular hair reconstruction system 10 is removed from the person's head and the double-sided adhesive tape 20 is removed.

The template 13 is replaced on the person's head and the person's head is marked to outline the front edge and the circumference of the template 13 to confirm the final placement. Any traces of hair within the marked bald portion is clipped. The person's head is shampooed, rinsed and dried. A hand-held electric head and neck massager is used on the person for three to five minutes. A mud pack is applied to the area of reconstruction and allowed to dry for approximately ten to fifteen minutes before being rinsed away. The bald portion is prepared by spraying alcohol over the cleansed area. The treatment reduces the presence of natural oils on the bald portion and facilitates adherence of the adhesive coated membrane to the person's head.

Figure 15:
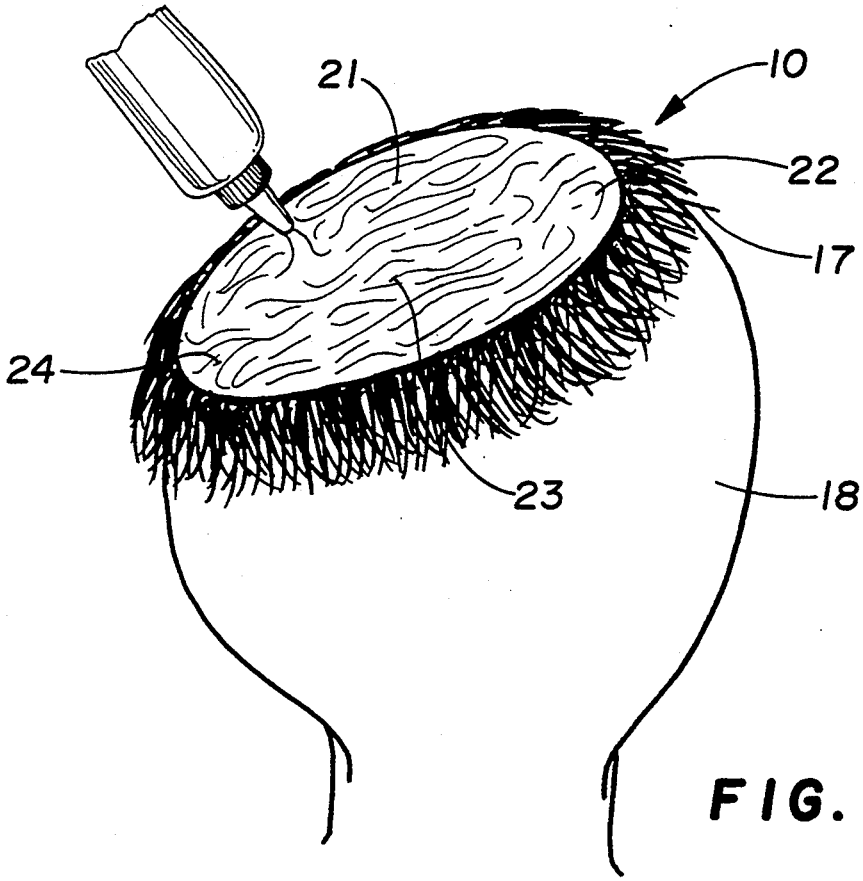
FIG. 15 is a perspective view showing the intracellular hair reconstruction system disposed on a mannequin head and the application of adhesive to the membrane surface.

The intracellular hair reconstruction system 10 is placed on the mannequin head 18 with the hair 17 in contact with the mannequin head 18 and the first side 15 of the membrane base 14 oriented outwardly from the mannequin head 18. A thin coating of adhesive 21 is applied uniformly over the first side 15 of the membrane base. Preferably the coating is approximately 1 mm to 5 mm in thickness (FIG. 15). The coating may be applied from a container having a spout using a small circular motion. The coating may also be applied by spraying, brushing or other methods. The adhesive coating 21 is preferably an acrylic resin solution type of adhesive which is in a volatile non-aqueous solvent media.

The first side 15 of the membrane 14 has a front section 22, a middle section 23 and a back section 24. The adhesive coating 21 is applied to the front section 22 and dried preferably with a hand-held drier 25 such as a hair drier, applied to the middle section 23 and dried with the hand-held drier 25 and applied to the back section 24 and dried with the hand-held drier 25 (FIG. 16). The drying with the hand-held drier is preferably performed in two steps. The first step uses high heat and low air flow for approximately one and one-half to two minutes. The second step uses high heat and high air flow for approximately one and one-half minutes. The effectiveness of the drier can be determined by observing tiny bubbles slowly rising to the surface of the coating 21. When properly heated, the coating 21 loses the fluid appearance. The heat from the hand-held drier rapidly evaporates the major portion of the solvent which is in the adhesive coating 21 and assists in bonding the adhesive coating 21 to the membrane base 14.

The intracellular hair reconstruction system 10 with the adhesive coating 21 on the first side 15 of the membrane base 14 is removed from the mannequin head 18 and the hair 18 is sprayed with water.

The intracellular hair reconstruction system 10 is placed on a flat surface with the hair 18 in contact with the surface and the adhesive coating 21 opposite from the surface. The intracellular hair reconstruction system 10 is placed in a preheated convection oven 26 for approximately three and one-half minutes at 250° F. (FIG. 17).

Figure 18:
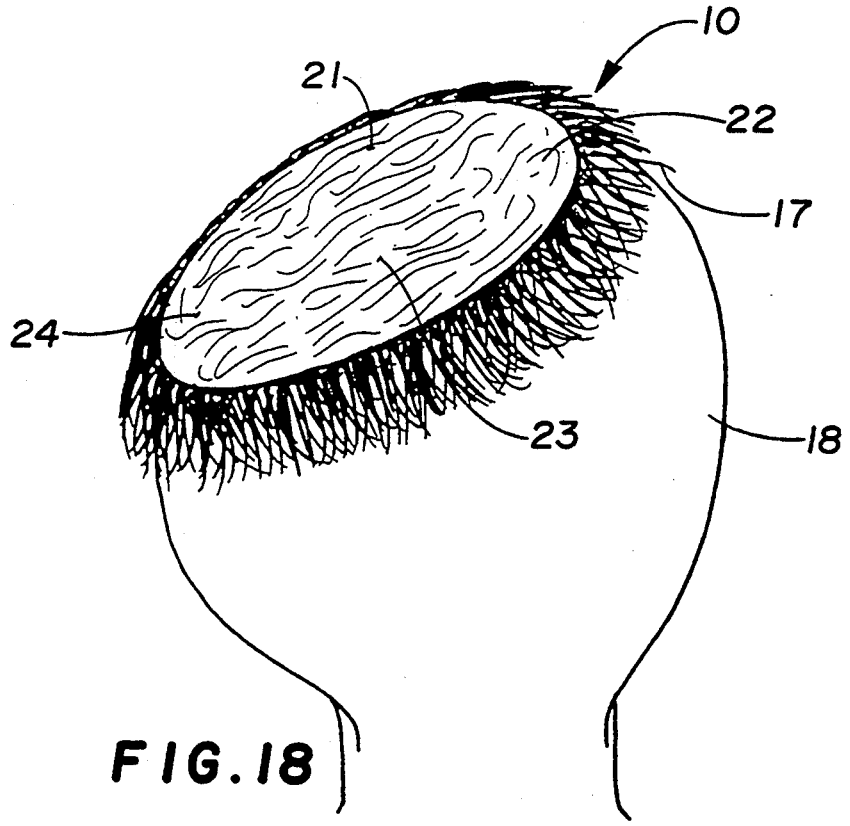
FIG. 18 is a perspective view of the intracellular hair reconstruction system showing the cured adhesive on the membrane.

The intracellular hair reconstruction system 10 is removed from the oven, placed on the mannequin head 18 and examined for completeness of cover of the adhesive coating 21 (FIG. 18). If the adhesive coating 21 is too thin or voids are found, the adhesive is applied and redried with the hand-held drier 25.

The hair 18 is lightly sprayed or misted with water.

Figure 19:
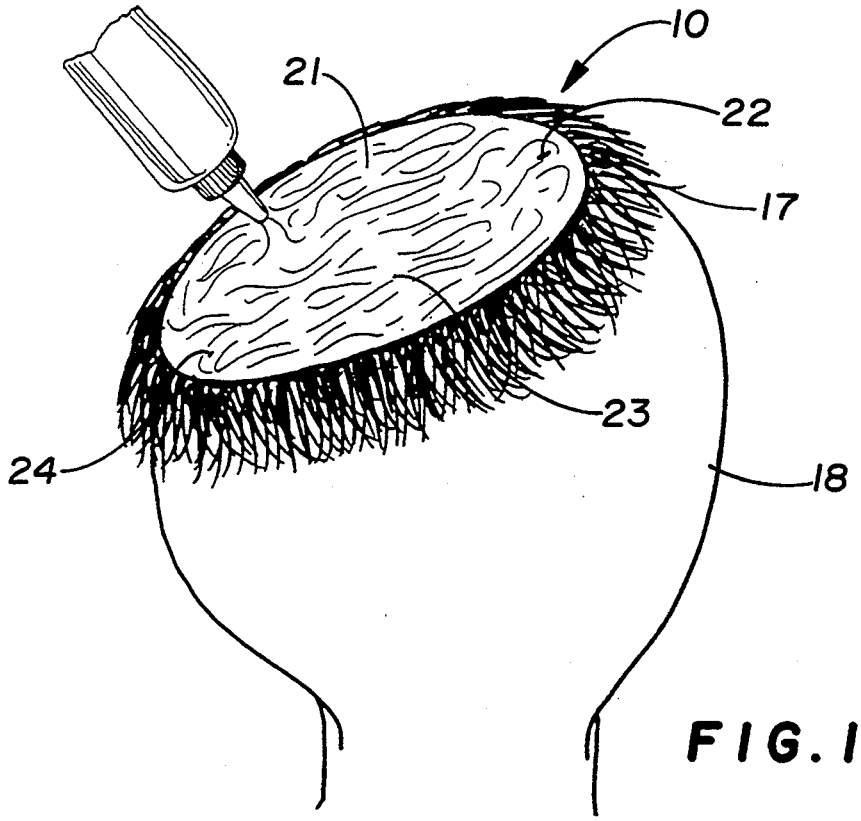
FIG. 19 is a perspective view showing application of additional adhesive to the membrane if required.

If desired, a very light and final bead of adhesive is laid on the first side 15 of the membrane base 14 in a zig-zag pattern (FIG. 19). The intracellular hair reconstruction system 10 is placed on the flat surface as previously described and placed in the preheated convection oven 26 for five minutes at approximately 250° F.

The intracellular hair reconstruction system 10 is removed from the convection oven 26. The adhesive coating 21 is inspected for full curing as determined by the appearance of tightly positioned tiny bubbles in the coating 21 which have a cloudy or frosty appearance.

Figure 20:
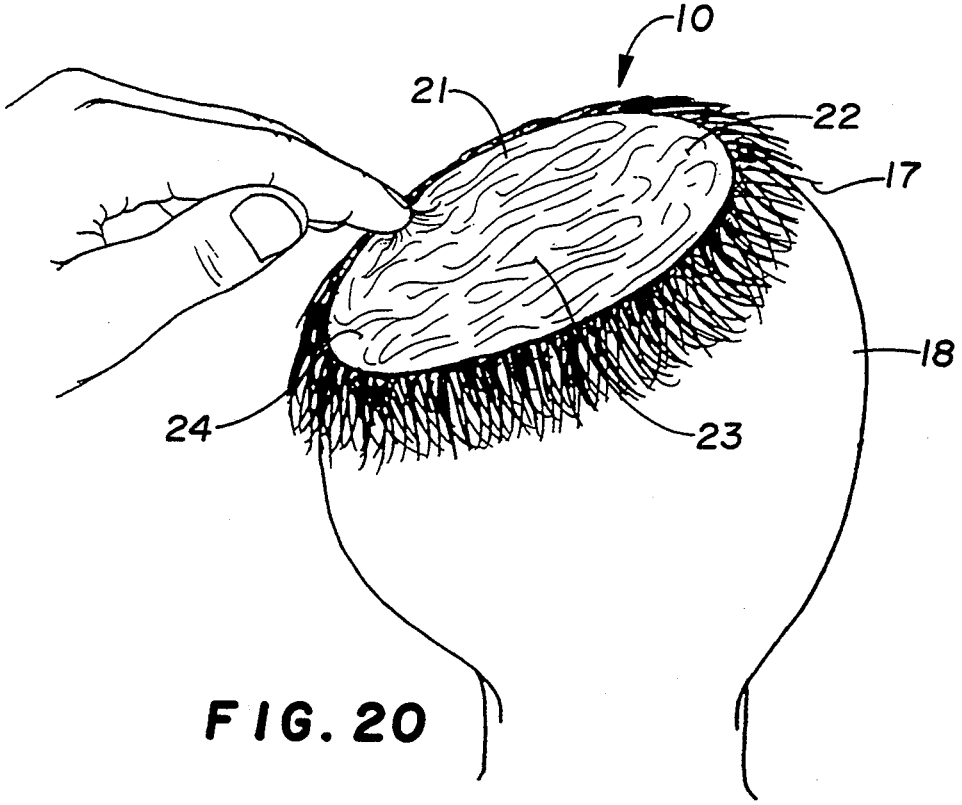
FIG. 20 is a perspective view showing the cured adhesive being tested for tackiness.

The intracellular hair reconstruction system 10 is placed on the mannequin head 18 with the hair 18 contacting the mannequin head 18. The adhesive coating 21 is tested for the proper degree of tackiness by placing a finger on the coating 21 in the middle section 23 of the membrane and quickly pulling away the finger while holding the hair 18 on the second side 16 of the membrane base 14 (FIG. 20). The desired degree of tackiness is indicated by the membrane 14 adhered to the adhesive coating 21 releasing from the finger and snapping back toward the mannequin head 18. If any particular area of the adhesive coating requires additional curing, the hand-held drier 25 is used to direct heat to the particular area.

Figure 21:
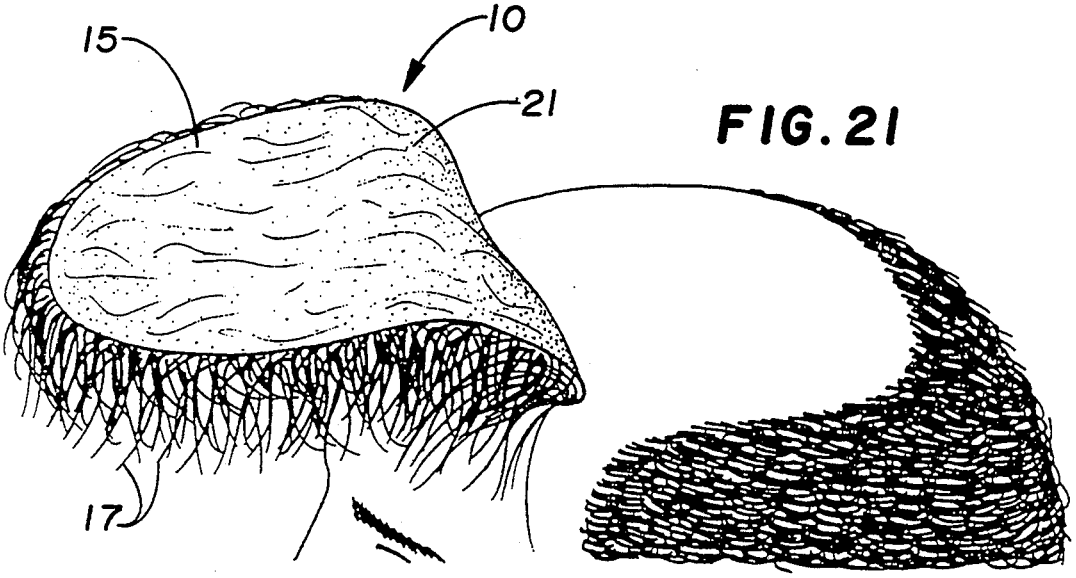
FIG. 21 is a perspective view showing placement of the adhesive coated membrane of the intracellular hair reconstruction system on the marked bald portion of the person, the membrane being adhered from the front of the head toward the back of the head.

When the adhesive coating 21 is considered to be properly cured based on the observations noted, the intracellular hair reconstruction system 10 is carefully aligned with markings on the person's head and the front edge of the first side 15 of the membrane base 14 is placed in contact with the marking at the front of the bald portion. The membrane base 14 is laid on the bald portion and the membrane base 14 is rolled toward the back of the bald portion while keeping the membrane base 14 taut as shown in FIG. 21. The intracellular hair reconstruction system 10 is completely disposed over the bald portion and is carefully pressed from the center outwardly to remove any entrapped air bubbles. The intracellular hair reconstruction system 10 must be applied on the bald portion within seven to ten minutes of the heating and curing of the adhesive covering 21 to assure the desired adhesion to the bald portion.

After adhesion of the intracellular hair reconstruction system, the hair 18 is cut, groomed and styled as desired.

Figure 22A:
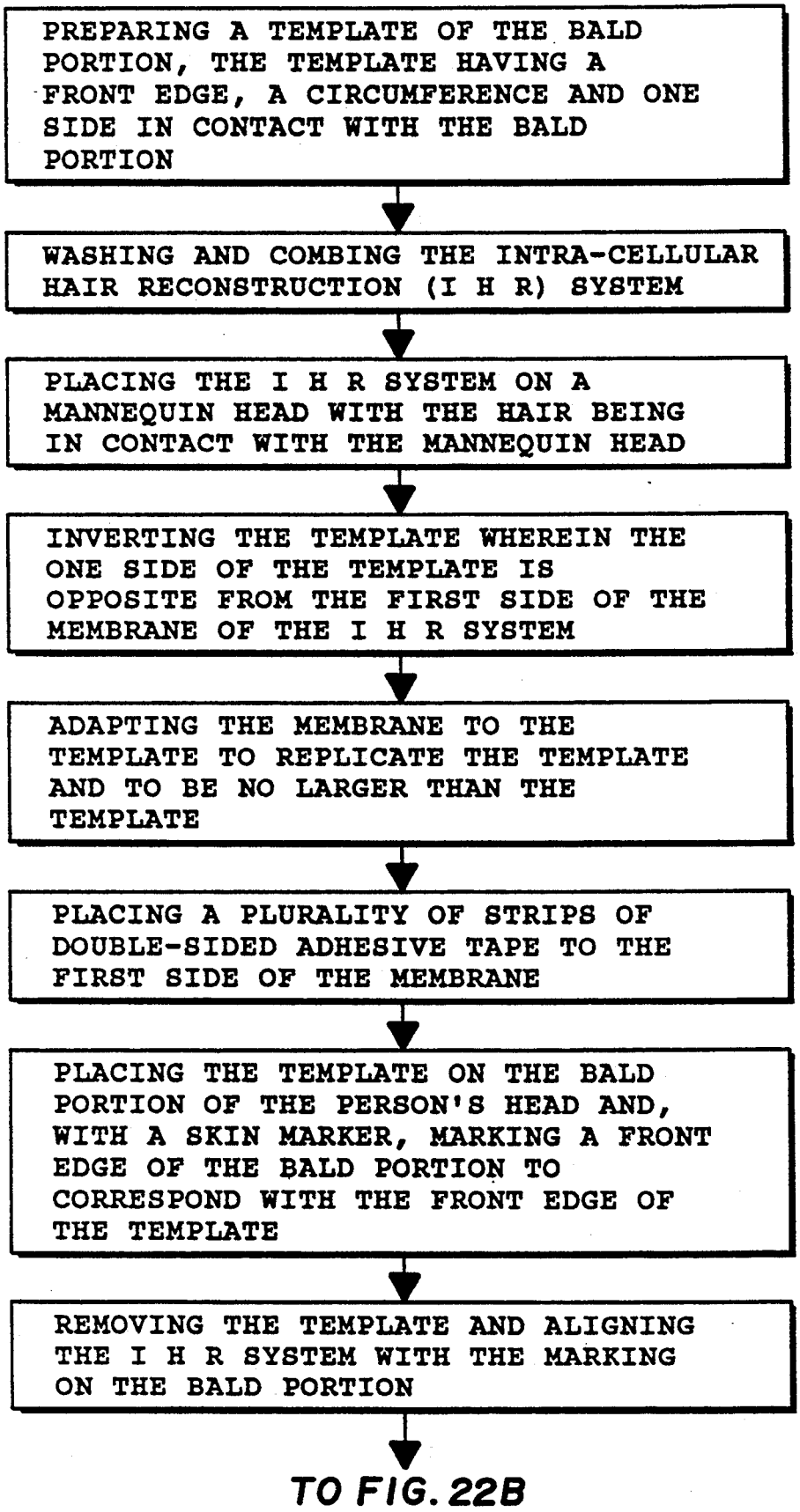
Figure 22B:
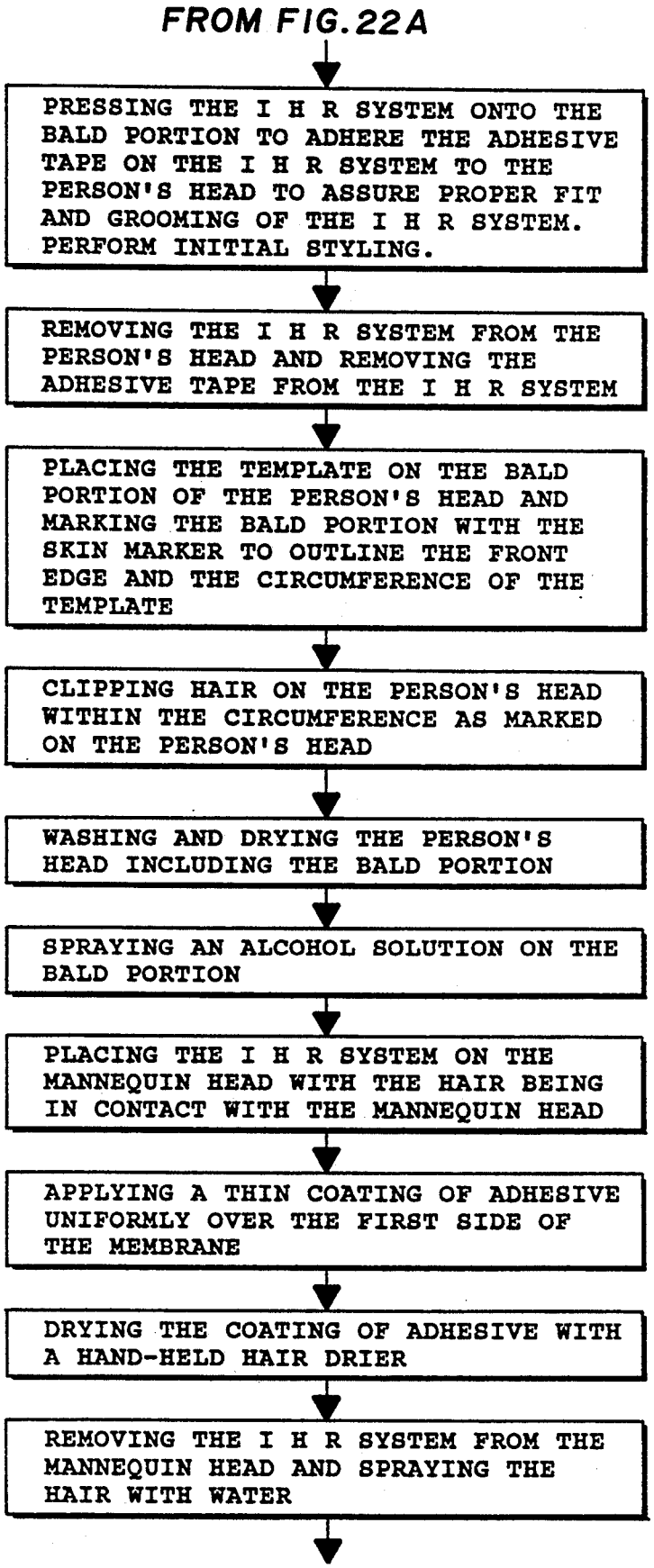

The method of the present invention (FIGS. 22A–22C) provides an artificial covering for a bald portion of a person's head which is natural in appearance and is very difficult to detect as being artificial. The person can engage in all types of activities including athletics, swimming and showering without any special precautions since the intracellular hair reconstruction system 10 is firmly secured to the person's head and does not shift from the marked location to which it is adhered. The person combs and grooms the intracellular hair reconstruction system in the same manner as the natural hair remaining on the person's head. The wearer has complete security and comfort in wearing the hair reconstruction system of the present invention. The intracellular hair reconstruction system is semi-permanent in that it remains adhered to the wearer's head for a period of weeks and is re-adhered when the adhesive requires replacement. The present invention eliminates the lumps, bumps, ridges and seams which are present in hairpieces presently commercially available.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A method for applying an intracellular hair reconstruction system to a person's head to cover a bald portion of the person's head, the intracellular hair reconstruction system having a plastic membrane base, the membrane base having a front edge, a first side and a second side, hair being attached to the membrane base and extending from the second side of the membrane base, the hair being customized to match the person's natural hair in color and texture, the method comprising the steps of:

preparing a template of the bald portion specific to the person, adapting the membrane base to the template to replicate the template, and be no larger than the template, preliminarily placing the intracellular hair reconstruction system on the person's head and adjusting the intracellular hair reconstruction system for desired fit and styling, marking the person's head for placement of the intracellular hair reconstruction system, removing the intracellular hair reconstruction system from the person's head, applying a uniform coating of adhesive on the first side of the membrane base, applying heat to the intracellular hair reconstruction system thereby curing the adhesive on the membrane base, after heating, placing the membrane base on the bald portion to conform with the marking on the person's head, pressing the membrane firmly against the bald portion whereby the intracellular hair reconstruction system is adhered to the person's head, wherein the membrane has a front section, a middle section and a back section, the adhesive being applied to the front section and dried with a hand-held drier, the adhesive being applied to the middle section and dried with the hand-held drier and the adhesive being applied to the back section and dried with the hand-held drier, wherein the drying with the hand-held drier is performed in two steps, the first step using high heat and low air flow for approximately one and one-half to two minutes and the second step using high heat and high air flow for approximately one and one-half minutes.

2. The method of claim 1, wherein the intracellular hair reconstruction system is placed in a preheated convection oven for approximately three and one-half minutes at approximately 250° F.

3. The method of claim 1, wherein the adhesive is applied to the membrane base from a container having a spout thereon.

4. The method of claim 1, wherein the adhesive is applied as a spray on the membrane base.

5. The method of claim 1, wherein the adhesive is brushed on the membrane base.

6. The method of claim 1, wherein the intracellular hair reconstruction system is placed on the bald portion of the person's head within seven to ten minutes after heat curing of the adhesive on the membrane base.

7. The method of claim 1, wherein the adhesive is an acrylic resin solution.

8. A method for applying an intracellular hair reconstruction system to a person's head to cover a bald portion of the person's head, the intracellular hair reconstruction system have a membrane base, the membrane base having a first side and a second side, hair being attached to the second side of the membrane base, the method comprising the steps of:

providing an adhesive and applying a uniform coating of adhesive on the first side of the membrane;

applying heat with a blow dryer to the coated adhesive;

placing the intracellular hair reconstruction system in a preheated convection oven to cure the adhesive;

removing the intracellular hair reconstruction system from the oven and checking the tackiness of the cured adhesive for the desired degree of drying;

applying the intracellular hair reconstruction system to the person's head with the adhesive being in contact with the bald portion.

9. The method of claim 8, wherein the adhesive is an acrylic resin in a volatile non-aqueous solvent.

10. The method of claim 8, wherein the adhesive is visually examined for curing by observing the absence of a wet appearance and the presence of closely positioned tiny bubbles in the adhesive coating.

11. The method of claim 8, wherein the adhesive is tested for tackiness by lightly pressing a finger to a middle section of the membrane and quickly pulling away the finger while holding the hair on the second side of the membrane, the desired degree of tackiness being indicated by the membrane adhered to the adhesive coating releasing from the finger and snapping back.

12. The method of claim 8, wherein the intracellular hair reconstruction system having the cured adhesive thereon is placed on the bald portion of the person's head within seven to ten minutes after removal from the oven.

13. The method of claim 8, further comprising placing the intracellular hair reconstruction system on a head form with the hair of the intracellular hair reconstruction system being in contact with the head form prior to applying a thin coating of adhesive uniformly over the first side of the membrane, blow drying the coated adhesive while the intracellular hair piece is disposed on the head form and removing the intracellular hair reconstruction system from the head form prior to placing the intracellular hair reconstruction system in the oven.

* * * * *